US010369423B2

(12) United States Patent
Lau et al.

(10) Patent No.: US 10,369,423 B2
(45) Date of Patent: Aug. 6, 2019

(54) BALL GAME RACKET WITH MAGNESIUM BRIDGE

(71) Applicant: Head Technology GmbH, Kennelbach (AT)

(72) Inventors: Daniel Lau, Dornbirn (AT); Stefan Mohr, Dornbirn (AT); Ralf Schwenger, Weiler-Simmerberg (DE)

(73) Assignee: Head Technology GmbH, Kennelbach (AT)

( * ) Notice: Subject to any disclaimer, the term of this patent is extended or adjusted under 35 U.S.C. 154(b) by 0 days.

(21) Appl. No.: 15/587,785

(22) Filed: May 5, 2017

(65) Prior Publication Data

US 2017/0319912 A1 Nov. 9, 2017

(30) Foreign Application Priority Data

May 6, 2016 (DE) ..... 10 2016 005 609
Jan. 23, 2017 (DE) ..... 10 2017 000 565

(51) Int. Cl.

| | |
|---|---|
| ***A63B 49/02*** | (2015.01) |
| ***A63B 49/10*** | (2015.01) |
| ***A63B 49/11*** | (2015.01) |
| ***B22D 17/00*** | (2006.01) |
| ***B22D 19/04*** | (2006.01) |
| ***B22D 21/00*** | (2006.01) |
| ***A63B 49/022*** | (2015.01) |
| ***A63B 49/028*** | (2015.01) |
| ***A63B 49/03*** | (2015.01) |
| ***A63B 60/50*** | (2015.01) |

(52) U.S. Cl.

CPC ..... *A63B 49/02* (2013.01); *A63B 49/022* (2015.10); *A63B 49/028* (2015.10); *A63B 49/03* (2015.10); *A63B 49/10* (2013.01); *A63B 49/11* (2015.10); *A63B 60/50* (2015.10); *B22D 17/007* (2013.01); *B22D 19/04* (2013.01); *B22D 21/007* (2013.01); *A63B 2049/0201* (2015.10); *A63B 2209/00* (2013.01); *A63B 2209/02* (2013.01)

(58) Field of Classification Search

CPC ..... A63B 49/02; A63B 49/022; A63B 49/03; A63B 60/50; A63B 60/52; A63B 49/10; A63B 49/11; A63B 49/028; A63B 2209/00; A63B 2209/02; A63B 2049/0201; B22D 19/04; B22D 21/007

See application file for complete search history.

(56) References Cited

U.S. PATENT DOCUMENTS 3,874,667 A 4/1975 Gallagher et al.
3,908,995 A * 9/1975 Portz ..... A63B 49/022 473/539

(Continued)

FOREIGN PATENT DOCUMENTS

DE 1 757 527 U 12/1957
DE 28 06 901 A1 8/1978

(Continued)

*Primary Examiner* — Raleigh W Chiu

(74) *Attorney, Agent, or Firm* — Bookoff McAndrews, PLLC

(57) ABSTRACT

The invention relates to a frame for a ball game racket comprising a handle region and a head region with a bridge, wherein a part of the head region and/or the handle region comprise(s) a carbon fiber composite material and wherein the bridge comprises magnesium and is formed as one part.

31 Claims, 11 Drawing Sheets

(56) References Cited

U.S. PATENT DOCUMENTS 4,114,880 A * 9/1978 Cecka ..... A63B 49/03 473/536
4,138,109 A * 2/1979 Nobbs ..... A63B 49/03 473/539
D253,713 S * 12/1979 Robinson ..... 473/546
D286,902 S * 11/1986 Tilley ..... D21/730
4,798,382 A * 1/1989 Janes ..... A63B 49/02 473/535
4,828,259 A * 5/1989 Davis ..... A63B 60/54 473/522
4,889,338 A * 12/1989 Keijiro ..... A63B 49/00 473/546
5,060,944 A * 10/1991 Janes ..... A63B 49/03 473/539
5,137,273 A * 8/1992 Jseng ..... A63B 49/022 473/543
5,141,228 A * 8/1992 Soong ..... A63B 49/025 473/521
D367,904 S * 3/1996 Hodges ..... D21/730
5,702,313 A * 12/1997 Stennett ..... A63B 49/02 473/546
6,319,158 B1 * 11/2001 Cheng ..... A63B 49/00 473/522
6,811,502 B1 * 11/2004 Janes ..... A63B 49/022 473/521
7,309,299 B2 * 12/2007 Pezzato ..... A63B 49/11 473/524
7,396,303 B2 * 7/2008 Gazzara ..... A63B 51/00 473/539
7,431,673 B2 * 10/2008 Niwa ..... A63B 51/00 473/524
8,002,651 B2 * 8/2011 Babolat ..... A63B 49/10 473/546
D689,573 S * 9/2013 Severa ..... D21/730
8,608,596 B1 * 12/2013 Chang ..... A63B 49/028 473/546
2003/0036447 A1 * 2/2003 Niwa ..... A63B 60/54 473/520
2003/0064838 A1 * 4/2003 Ashino ..... A63B 49/03 473/535
2007/0123377 A1 * 5/2007 Gazzara ..... A63B 51/00 473/540
2007/0135245 A1 * 6/2007 Gazzara ..... A63B 51/00 473/524
2010/0048333 A1 * 2/2010 Cottey ..... A63B 49/02 473/521
2011/0201461 A1 * 8/2011 Gazzara ..... A63B 60/50 473/527
2017/0050090 A1 * 2/2017 Lau ..... A63B 49/10
2017/0319912 A1 * 11/2017 Lau ..... A63B 49/02

FOREIGN PATENT DOCUMENTS

DE 10 2013 011 174 A1 1/2015
GB 2 004 467 A 4/1979
JP 2004 081679 A 3/2004

* cited by examiner

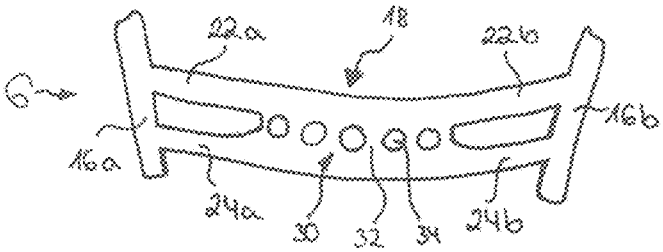
Fig. 5A
Fig. 5B
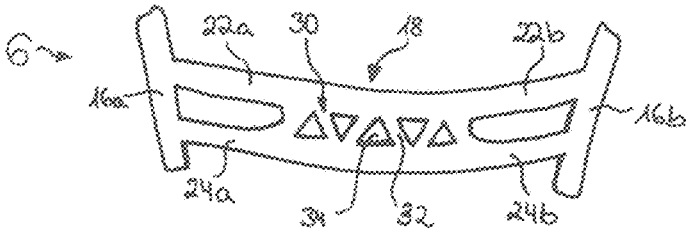
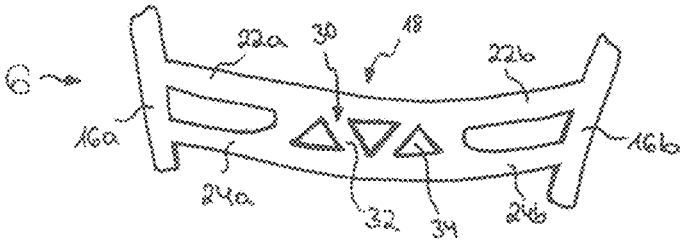
Fig. 5C
Fig. 5D
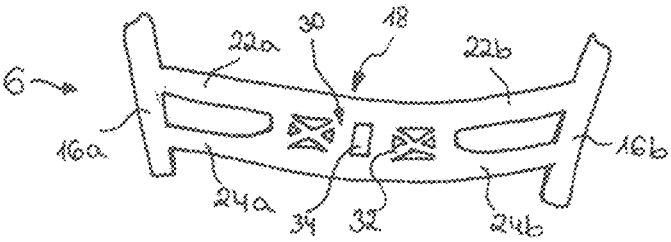

BALL GAME RACKET WITH MAGNESIUM BRIDGE

This patent application claims the benefit under 35 U.S.C. § 119 to German Patent Application No. 10 2017 000 565.6, filed Jan. 23, 2017, and German Patent Application No. 10 2016 005 609.6, filed May 6, 2016, the entireties of each of which are incorporated herein by reference.

The present invention relates to a frame for a ball game racket, which comprises, in portions, different materials and in particular comprises a magnesium-containing bridge.

After initial models made of wood, so far mainly aluminum or carbon fiber composite materials have been used for the frame of a ball game racket, in particular a tennis racket. Moreover, it is known to use magnesium or magnesium alloys in frames of ball game rackets, for example from U.S. Pat. No. 3,874,667 A, the German utility model DE 1 757 527 U and DE 10 2013 011 174 A1.

A disadvantage of the present frame models is a restriction in view of the design and thus a restriction in the mechanical properties. Many of these restrictions are due to the manufacturing methods and/or the necessity to incorporate the string bed and/or redirect the strings. This particularly also applies to a bridge of a frame of a ball game racket. For example, when using the blow tube molding, filigree structures can be made only in a relatively complex manner or cannot be made at all. Furthermore, it is also quite difficult to connect several components, as disclosed in DE 10 2013 011 174 A1, in particular if, e.g., filigree and/or particularly thin-walled structures are to be made.

The present invention deals with the problem of providing a frame for a ball game racket which overcomes the above-mentioned problems at least in part, can be manufactured easily and is particularly stable in particular in the area of the bridge.

This problem is solved by a frame for a ball game racket according to claim 1. The frame according to the invention can basically be used for any known type of ball game racket, in particular for tennis rackets, squash rackets and badminton rackets.

The frame according to the invention comprises a handle region as well as a head region with bridge, wherein the bridge can form as usual a heart region together with two frame bars. The frame defines a substantially two-dimensional string bed in the string bed plane for receiving a stringing.

A part of the head region and/or the handle region comprise(s) a carbon fiber composite material. The bridge comprises magnesium and is formed as one part. Preferably, substantially the entire bridge is made from a magnesium-containing material or a magnesium alloy. Moreover, it is preferred that the entire remaining frame is made from a carbon fiber composite material.

In connection with the present invention, the one-part form of the bridge means the one-part form of the supporting structure of the bridge, wherein the bridge should be considered as being one part despite one or more additional component(s) such as, e.g., a damper, a grommet or a grommet band, a weight or weight band and/or a coating in the form of a primer coat, a varnish, a plastic layer and/or the like. In particular, the bridge is not composed of two halves or partial portions as disclosed, e.g., in DE 10 2013 011 174 A1. Moreover, in particular the magnesium-containing part of the bridge is made from one single part and is not formed of a plurality of interconnected portions. For example, the bridge can be one single cast part.

Such a bridge in the one-part form is advantageous in that on the one hand it can be made particularly easily, e.g., by one single casting step, and on the other hand it is particularly stable. In particular, it turned out that bridges being composed of a plurality of parts are susceptible to fracture and/or deformation at the joints. Magnesium-containing alloys turned out to be particularly advantageous in this regard because they are on the one hand relatively lightweight and on the other hand extremely stable. Since particularly large forces appear in the bridge area when the racket is used for playing, the playing behavior of a racket according to the invention can be improved substantially and at the same time the stability of the racket can be improved. In this connection, the racket according to the invention is also superior to rackets which are made completely from a light metal such as, e.g., aluminum because the frame regions made from the common carbon fiber composite material exhibit clearly improved stiffness-to-weight ratios and accordingly positive dampening properties.

In a preferred embodiment, the bridge is made substantially from a uniform material, for example from a uniform magnesium alloy. Variations in the material composition and/or mixture known in view of the materials and/or manufacturing methods form part of the tolerance range of the present invention.

In a preferred embodiment, the bridge comprises at least 50 weight-%, preferably at least 80 weight-%, preferably at least 90 weight-%, preferably at least 95 weight-% magnesium. Particularly preferably, the bridge comprises a magnesium alloy. The magnesium alloy is preferably, e.g., AM60 or a fiber- or particle-reinforced alloy, particularly preferably SAE SiC/AZ91.

The bridge can be made, for example, in a (pressure) die casting process or an injection molding process and, in particular, with semi-solid metal casting such as thixocasting or thixomolding, with thixomolding being particularly preferred. The bridge can be placed together with prepreg layers, which form a part of the head region and/or the handle region after finishing, into a blow tube mold and pressed. Alternatively or additionally, the bridge can be connected to the remaining frame in another way, e.g. by bonding, pressing, curing, welding, riveting and/or screwing.

Preferably, the entire bridge or at least portions thereof are made as a solid profile or are solid. In particular, at least in portions, the bridge does not have a hollow-profile/tube-like structure. In contrast to the use of hollow profiles, this allows also particularly filigree structures to be made. For example, it is thus possible to direct the flux of force in the area of the bridge and in particular in the transition areas between bridge and remaining frame in a well-aimed manner. In connection with conventional methods, this was, e.g., only to some extent possible by orienting the prepreg layers in different ways or by varying the wall thickness of hollow bodies. The combination of particularly stable magnesium alloys and solid structures, however, allows the formation of perfectly placed stabilization webs (or ligaments or beams) or lattice-like (or truss-like) structures, which can be very filigree and accordingly lightweight.

In the context of the present application, the term solid profile means a profile in which substantially no hollow spaces are present, in particular no closed hollow spaces which can only be accessed through string openings. In the context of the present invention, a string opening is an opening in the frame of a ball game racket which serves for passing one or more strings through the frame and the diameter of which exceeds the string diameter only so much that the string can be passed easily through it, even and in particular if additionally an eye or a similar component is inserted into the string opening. Thus, solid profiles can definitely have notches or recesses and the like. However, a cross-section through a solid profile does not have an area in which a hollow space is surrounded by a material cover that is closed or closed except for string openings. In particular, a cross-section of a bridge region with solid profile can have exactly one or more coexisting solid profiles. In the context of the present invention, the cross-section is a section perpendicular with respect to the directrix of the frame region. In the context of the present invention, the directrix of a frame region is understood to be a channel surface directrix, i.e. the line which extends centrally through a frame region thereby substantially following the frame contour.

In a preferred embodiment, the bridge has at least four, preferably at least six webs. In a further embodiment, the bridge has at least eight webs. A web or arm is understood to be an elongate, relatively thin structure, the length of which is many times greater than the minimum cross-sectional extension. Preferably, the ratio of length to minimum cross-sectional extension is 5:1, more preferably 10:1 and particularly preferably 15:1. Such a web has a cross-sectional area which is clearly smaller than the maximum cross-sectional area of the bridge. In the cross-section, a web has preferably a solid profile, particularly preferably a convex solid profile, for example a convex polygonal, oval or round solid profile, and/or a substantially U- and/or V-shaped solid profile and/or a different concavely polygonal solid profile. A corner of a profile can be pointed or rounded. However, the web can also have, in portions, a hollow cross-section.

The webs can each have, at least in portions, a cross-sectional area of up to 100 $mm^2$, preferably up to 50 $mm^2$, more preferably up to 30 $mm^2$, particularly preferably up to 25 $mm^2$. In particular, the webs can each have, at least in portions, a cross-sectional area of 1 $mm^2$ to 100 $mm^2$, but they preferably each have a cross-sectional area of 1 $mm^2$ to 50 $mm^2$, preferably 2 $mm^2$ to 30 $mm^2$, particularly preferably 2 $mm^2$ to 25 $mm^2$. The cross-sectional area of the webs can vary along the web directrix. In particular, the area of the web cross-section can increase continuously from a web region being relatively close to the center of the bridge to a web region being less close to the center.

In portions, webs can be separated from each other preferably along at least 5 mm, more preferably along at least 10 mm, more preferably along at least 15 mm, more preferably along at least 20 mm, more preferably along at least 30 mm, more preferably along at least 40 mm, more preferably along at least 50 mm, particularly preferably along at least 60 mm, preferably measured along the frame profile. In places and/or in portions, the webs can be connected in pairs and/or to a plurality of other webs. In particular, webs made from a magnesium-containing material can be connected via intermediate parts, which can be made from a different material. For example, one or more dampening elements can be provided between two or more webs.

Two neighboring webs, which can also be referred to as pair of webs, preferably have, at least in portions, a surface distance of 1 mm or more, more preferably of 3 mm or more, particularly preferably of 5 mm or more, measured perpendicularly with respect to the string bed plane and between their surfaces. Two neighboring webs preferably have, at least in portions, a surface distance of 30 mm or less, more preferably of 20 mm or less, more preferably of 15 mm or less, particularly preferably of 10 mm or less, measured perpendicularly with respect to the string bed plane. In particular, two neighboring webs preferably have, at least in portions, a surface distance of 1 mm to 30 mm, preferably of 1 mm to 20 mm, more preferably of 3 mm to 15 mm, particularly preferably of 5 mm to 10 mm, measured perpendicularly with respect to the string bed plane. The surface distance between two neighboring webs, measured perpendicularly with respect to the string bed plane, can vary along the directrix of the webs. Likewise, the surface distance of two webs of a first pair of webs can differ from the surface distance of two webs of a second pair of webs.

Two neighboring webs preferably have, at least in portions, a surface distance of 1 mm or more, more preferably of 3 mm or more, particularly preferably of 5 mm or more, measured parallel with respect to the string bed plane. Two neighboring webs preferably have, at least in portions, a surface distance of 30 mm or less, more preferably of 20 mm or less, more preferably of 15 mm or less, particularly preferably of 10 mm or less, measured parallel with respect to the string bed plane. In particular, two neighboring webs preferably have, at least in portions, a surface distance of 1 mm to 30 mm, preferably of 1 mm to 20 mm, preferably of 3 mm to 20 mm, preferably of 3 mm to 15 mm, preferably of 5 mm to 10 mm, measured parallel with respect to the string bed plane. The surface distance between two neighboring webs, measured parallel with respect to the string bed plane, can vary along the directrix of the webs. Likewise, the surface distance of two webs of a first pair of webs can differ from the surface distance of two webs of a second pair of webs.

The webs preferably have a length LS along the directrix of the web. The length LS is preferably greater than or equal to 1 mm, more preferably greater than or equal to 5 mm, more preferably greater than or equal to 10 mm, more preferably greater than or equal to 15 mm, particularly preferably greater than or equal to 20 mm. The length LS is preferably smaller than or equal to 120 mm, more preferably smaller than or equal to 100 mm, more preferably smaller than or equal to 80 mm, more preferably smaller than or equal to 50 mm, particularly preferably smaller than or equal to 30 mm. In particular, the webs have preferably a length LS along the directrix of the web of 1 mm to 120 mm, preferably 5 mm to 120 mm, preferably of 10 mm to 100 mm, preferably of 15 mm to 80 mm, preferably of 20 mm to 50 mm, particularly preferably of 20 mm to 30 mm.

A preferred embodiment of the bridge according to the invention comprises at least one bracket or mounting link which serves for connecting the bridge to at least one further frame region. The bracket does not only guarantee a stable connection between bridge and remaining frame, but it also allows an extensive or wide-spread transmission of the forces occurring in the bridge into the remaining frame. The bridge preferably has two brackets. Preferably, the brackets are substantially arranged at opposing ends of the bridge. Furthermore, embodiments with one, four, six or more brackets are possible. In particular, embodiments in which each web leads into its own bracket into which no other web leads, and/or in which two webs lead into a common bracket into which no other web leads, and/or in which three webs lead into a common bracket into which no other web leads are possible. In particular, there is an embodiment in which three out of a total of six webs lead into a first bracket and the other three out of a total of six webs lead into a second bracket. In an alternative embodiment, a first and a second web out of six webs lead into a first bracket, a third and a fourth web out of six webs lead into a second bracket, a fifth web leads into a third bracket, and a sixth web leads into a fourth bracket. In an alternative embodiment, six out of a total of six webs lead into a respective one of a total of six brackets. The webs can lead directly into the brackets and/or into a different bridge region and/or frame region located between webs and brackets.

Preferably, the central region of the bridge is formed as solid profile having a groove. The groove is preferably open towards the string bed and can otherwise be closed. The groove-shaped central region thus can have the shape of an open groove and/or the shape of a pot. Alternatively or additionally, the central region of the bridge can have a lattice or truss structure. In a further embodiment, the central region has a solid profile without groove.

Preferably, the bridge of a frame according to the invention has a continuous cross-sectional profile on a continuous bridge length of 5 mm or more, preferably of 10 mm or more, more preferably of 15 mm or more, more preferably of 20 mm or more, particularly preferably of 30 mm or more along the directrix of the bridge, and/or a discontinuous cross-sectional profile on a continuous bridge length of 5 mm or more, preferably of 10 mm or more, more preferably of 15 mm or more, more preferably of 20 mm or more, particularly preferably of 30 mm or more along the directrix of the bridge. Preferably, according to the invention, a cross-section through the bridge for a frame for a ball game racket has a continuous cross-sectional profile along a continuous bridge length of 100 mm or less, preferably 80 mm or less, more preferably 60 mm or less along the frame contour and/or has a discontinuous cross-sectional profile along a continuous bridge length of 100 mm or less, preferably, 80 mm or less, more preferably 60 mm or less along the frame contour. Preferably, according to the invention, a cross-section through the bridge for a frame for a ball game racket has a continuous cross-sectional profile along a continuous bridge length of between 10 mm and 100 mm, preferably between 30 mm and 80 mm along the frame contour and/or has a discontinuous cross-sectional profile along a continuous bridge length of between 5 mm and 100 mm, preferably between 10 mm and 60 mm along the frame contour.

A frame according to the invention is intended for receiving a stringing. The stringing preferably consists of longitudinal strings and transverse strings, wherein the longitudinal strings are arranged substantially parallel with respect to the longitudinal axis of the frame and substantially perpendicular with respect to the transverse strings. Alternatively or additionally, strings can be arranged at an angle relative to the longitudinal axis of the frame which is different from 0° and/or 90°. For example, the longitudinal strings can extend in a substantially fan-shaped manner and the transverse strings substantially perpendicularly with respect to the longitudinal axis of the frame. In accordance with the common usage in the present technical field, in the context of the present application, each string region extending between two frame points is called string. However, the person skilled in the art is well aware of the fact that the entire stringing can be made from one single, from two or from more string pieces. If the stringing consists of less string pieces than strings, the one or the more string piece(s) is/are redirected at the frame in order to form the individual strings.

Preferably, at least one bracket comprises at least one string opening as specified above in this application for passing at least one longitudinal and/or transverse string through it. Particularly preferably, two brackets each have a string opening for passing through at least one longitudinal and/or transverse string. Alternatively, none of the brackets has a string opening.

In a preferred embodiment, two webs of the bridge each have at least one string opening as specified above in this application for passing at least one longitudinal and/or transverse string through it. Preferably, two webs have two string openings each. In an alternative embodiment, two webs each have one, two, three, four and/or more string openings. In an embodiment, four or six webs each have one string opening. However, there are also embodiments in which none of the webs has a string opening.

Preferably, the central region has at least one string opening as specified above in this application for passing at least one longitudinal string through it. Preferably, the central region has a plurality of string openings. However, it is also possible that the central region does not have any string openings, for example in an embodiment in which the central region has a particularly short extension along the directrix of the bridge.

The groove-shaped central region can comprise, in addition to the one-part, supporting base structure of the bridge, a damper provided for reducing vibrations. The damper preferably comprises rubber-like or elastic or viscoelastic materials such as TPU or TPE and general materials from the class of thermo elastomers or thermoplastic elastomers. The damper can fill the groove in the groove-shaped central region of the bridge except for the string openings completely and/or in portions completely. Preferably, however, it has recesses which do not serve for passing strings through them. The damper can consist of multiple parts, however, preferably it is one single part. The damper can be fixed to the bridge, for example by bonding, vulcanization, pressing and/or other known methods. However, the damper is preferably at least removable from the bridge. When the ball is hit, a sufficient fixation of the damper is preferably guaranteed in that the damper has, at least in portions, the negative shape of the groove-shaped central region. This leads to adhesion between damper and bridge, which prevents undesired movement of the damper. Alternatively or additionally, the damper can be clamped between at least two strings, as is common in connection with known dampers for tennis. In a particularly preferred embodiment, however, the damper has openings for passing strings through it, preferably at least two strings, particularly preferably at least four strings. According to the invention, such a damper with string openings is inserted into the groove-shaped central region of the bridge of the frame of a non-stringed ball game racket. The string openings are positioned in the damper in extension of corresponding string openings of the groove-shaped central region of the bridge. When stringing the frame of the ball game racket, the strings which are intended to be provided to the groove-shaped central region of the bridge are passed through the respectively provided string opening of the groove-shaped central region of the bridge and through the respectively corresponding string opening of the damper. Thus, it is in particular excluded that the damper pops out of the ball game racket due to the impact of a strike and must laboriously be searched and reinserted, which is often the case with commercially available dampers which are clamped between two longitudinal strings.

In a preferred embodiment, the bridge according to the invention and/or the frame of the ball game racket according to the invention is symmetrical with respect to the longitudinal axis of the racket and/or symmetrical with respect to the string bed plane.

A preferred embodiment of a bridge according to the invention has a geometrical moment of inertia Iy and a geometrical moment of inertia Iz, wherein Iy and Iz are defined as follows: Iy and Iz each relate to bridge sections being perpendicular with respect to the stationary x-axis (i.e. lie in a y-z plane), wherein the right-handed Cartesian coordinate system is defined such that the y-axis is congruent with the longitudinal axis of the frame, the origin lies in the center of area of the central plane of the bridge, and the y-axis extends from the handle in the direction towards the head region. The central plane of the bridge is the cross-section of the bridge formed through the center and perpendicularly with respect to the directrix. This means that a racket having a common shape has negative y-values in the handle region and positive y-values in a substantive part of the head region. It is pointed out that the bridge regions extending perpendicularly with respect to the x-axis are not necessarily cross-sections in the meaning of the definition of the present application, because bridge cross-sections are defined as being perpendicular with respect to the directrix of the bridge. For reasons of clarification, the sections perpendicular with respect to the x-axis are in the following called yz-sections, because they lie in yz-planes. Iy and Iz can vary with the position on the x-axis, i.e. Iy(x) and Iz(x), for example, when the shape of the yz-section changes along the x-axis. Iy is the geometrical moment of inertia for a bend about the y-axis, i.e. a force acting on the bridge is in this case acting in the z-direction. Iz is the geometrical moment of inertia for a bend about the z-axis, i.e. a force acting on the bridge is in this case acting in the y-direction. In terms of mathematics, the geometrical moments of inertia for a yz-section are $Iy=\iint z^2 dydz$ and $Iz=\iint y^2 dydz$. Thus, Iz is the geometrical moment of inertia that is relevant to the force transmitted during a ball contact from the longitudinal strings to the bridge in the y-direction.

In the following, the characteristics of Iz(x) and Iy(x) are discussed in more detail. In particular, Iz(x) and Iy(x) are compared with each other. In the entire present application, a comparison of Iz(x) and Iy(x) always means the comparison with like x-values.

In a preferred embodiment of the bridge, its geometrical moment of inertia Iz(x) along the x-axis is, at least in portions, larger than the geometrical moment of inertia Iy(x). Alternatively or additionally, Iy(x) can be, at least in portions, larger than Iz(x). The difference of Iz(x)−Iy(x) and/or the quotient of Iz(x)/Iy(x) and/or the values of Iy(x) and Iz(x) can vary with the x-value, namely in each case for x larger than/equal to zero and/or x smaller than zero.

In a preferred embodiment, the value of Iz(x) is at least in portions, preferably in portions in a web region of the bridge, 2500 $mm^4$ or more, preferably 3000 $mm^4$ or more, more preferably 3500 $mm^4$ or more, more preferably 4000 $mm^4$ or more, particularly preferably 4500 $mm^4$ or more. Alternatively or additionally, the value of Iz(x) can be at least in portions, preferably in portions in a web region of the bridge, 6500 $mm^4$ or less, preferably 6000 $mm^4$ or less, more preferably 5500 $mm^4$ or less, particularly preferably 5000 $mm^4$ or less. Preferably, the value of Iz(x) lies at least in portions, preferably in portions in a web region of the bridge, in a range of 2500 $mm^4$ to 6500 $mm^4$, preferably 3000 $mm^4$ to 6000 $mm^4$, more preferably 3500 $mm^4$ to 5500 $mm^4$, more preferably 4000 $mm^4$ to 5500 $mm^4$, particularly preferably 4500 $mm^4$ to 5000 $mm^4$. Alternatively or additionally, the value of Iz(x) can be at least in portions, preferably in portions in the central region of the bridge, 3500 $mm^4$ or less, preferably 3000 $mm^4$ or less, more preferably 2500 $mm^4$ or less, more preferably 2000 $mm^4$ or less, more preferably 1750 $mm^4$ or less, particularly preferably 1500 $mm^4$ or less. Alternatively or additionally, the value of Iz(x) can be at least in portions, preferably in portions in the central region of the bridge, 100 $mm^4$ or more, preferably 250 $mm^4$ or more, more preferably 500 $mm^4$ or more, more preferably 750 $mm^4$ or more, more preferably 1000 $mm^4$ or more, particularly preferably 1250 $mm^4$ or more. Preferably, the value of Iz(x) is at least in portions, preferably in portion in the central region of the bridge, in a range of 100 $mm^4$ to 3500 $mm^4$, preferably 250 $mm^4$ to 3000 $mm^4$, more preferably 500 $mm^4$ to 2500 $mm^4$, more preferably 750 $mm^4$ to 2000 $mm^4$, more preferably 1000 $mm^4$ to 1750 $mm^4$, particularly preferably 1250 $mm^4$ to 1500 $mm^4$.

Alternatively or additionally, the value of Iy(x) can be at least in portions, preferably in portions in a web region and/or in the transition region from a web region to the central region of the bridge, 100 $mm^4$ or more, preferably 250 $mm^4$ or more, more preferably 500 $mm^4$ or more, more preferably 1000 $mm^4$ or more, more preferably 1500 $mm^4$ or more, more preferably 2000 $mm^4$ or more, particularly preferably 2300 $mm^4$ or more. Alternatively or additionally, the value of Iy(x) can be at least in portions, preferably in portions in a web region and/or in the transition region from a web region to the central region of the bridge, 4000 $mm^4$ or less, preferably 3500 $mm^4$ or less, more preferably 3000 $mm^4$ or less, particularly preferably 2500 $mm^4$ or less. Preferably, the value of Iy(x) is at least in portions, preferably in portions in a web region and/or in the transition region from a web region to the central region of the bridge, in a range of 100 $mm^4$ to 4000 $mm^4$, preferably 500 $mm^4$ to 3500 $mm^4$, more preferably 1000 $mm^4$ to 3000 $mm^4$, more preferably 1500 $mm^4$ to 2500 $mm^4$, particularly preferably 2300 $mm^4$ to 2500 $mm^4$. Alternatively or additionally, the value of Iy(x) can be at least in portions, preferably in portions in the central region of the bridge, 100 $mm^4$ or more, preferably 250 $mm^4$ or more, more preferably 500 $mm^4$ or more, particularly preferably 750 $mm^4$ or more. Alternatively or additionally, the value of Iy(x) can be at least in portions, preferably in portions in the central region of the bridge, 2500 $mm^4$ or less, preferably 2000 $mm^4$ or less, more preferably 1500 $mm^4$ or less, particularly preferably 1000 $mm^4$ or less. Preferably, the value of Iy(x) is at least in portions, preferably in portions in the central region of the bridge, in a range of 100 $mm^4$ to 2500 $mm^4$, preferably 250 $mm^4$ to 2000 $mm^4$, more preferably 500 $mm^4$ to 1500 $mm^4$, particularly preferably 750 $mm^4$ to 1000 $mm^4$.

In a preferred embodiment of the bridge, Iz(x) differs from Iy(x) at least in portions by 2000 $mm^4$ or less, preferably 1500 $mm^4$ or less, particularly preferably 1000 $mm^4$ or less, and in each case for $x \geq 0$ and/or $x<0$. Alternatively or additionally, Iz(x) differs from Iy(x) along the x-axis at least in portions by 1500 $mm^4$ or more, preferably 2000 $mm^4$ or more, more preferably 2500 $mm^4$ or more, in each case for $x \geq 0$ and/or $x<0$.

In a preferred embodiment of the bridge, there is at least one value pair d1 and d2 having like signs, for which Iz(x) is larger at the place x=d1 than at the place x=d2 and Iy(x) is smaller at the place x=d1 than at the place x=d2. Here, d1 can be larger than d2. Alternatively or additionally, a value pair d1 and d2 can exist in which d2 is larger than d1.

In a preferred embodiment, the bridge has at least one region A1, in which Iz(x) increases as the absolute value of x increases and in which Iy(x) decreases as the absolute value of x increases. Such a region A1 can comprise one or more bridge regions with bridge webs. Particularly preferably, the bridge has at least two regions A1, but the bridge can also have at least three, at least four or even more regions A1. The one or the more regions A1 preferably each have an extension in the x-direction of 1 mm or more, preferably 5 mm or more.

Furthermore, a bridge according to the invention can have one or more regions A2, wherein Iy(x) and Iz(x) have substantially the same absolute change within a region A2. Preferably, at least one of the regions A2 comprises the central plane of the bridge. Alternatively, none of the regions A2 can comprise the central plane of the bridge. Preferably, the one or more regions A2 each extend in the x-direction by at least 5 mm, more preferably at least 10 mm, more preferably at least 15 mm, more preferably at least 20 mm, more preferably at least 25 mm, more preferably at least 30 mm, more preferably at least 35 mm, more preferably at least 40 mm, more preferably at least 45 mm, particularly preferably at least 50 mm. Particularly preferably, the center of at least one of the regions A2 has an x-coordinate value of zero. In particular, a bridge according to the invention can have a region A2 about the origin of the coordinate system and two regions A1, wherein one region A1 is in the positive and one region A1 is in the negative x-axis range.

In a preferred embodiment of the bridge, in an x-value range A3 of 15 mm or less, preferably 10 mm or less, particularly preferably 5 mm or less, the value of Iz(x) and/or the value of Iy(x) has a variation of at least 100% of its smallest value in the monitored x-value range.

In connection with the ranges or regions A1 to A3 described above, it is pointed out that the characteristics of Iy and Iz described for these ranges should be understood in the meaning of global characteristics. This means that the behavior of the geometrical moments of inertia is considered in an overview or also on the whole, whereas single outliers are not taken into consideration. In particular, geometrical moments of inertia of yz-sections with string openings are to be categorized as outliers.

In a preferred embodiment, Iz(x) has at least a minimum. Alternatively or additionally, Iy(x) has preferably a maximum. Also the maxima and minima refer to the behavior of the geometrical moments of inertia on the whole and not to outliers.

Moreover, the present invention relates to a method for producing a frame or a frame region for a ball game racket. Preferably, the frame or frame region produced by means of the method according to the invention has the above-mentioned properties.

According to the method for producing a frame or frame region according to the invention, a bridge is cast from a material which comprises magnesium. Preferably, this is done by so-called thixomolding.

Moreover, the production method comprises providing a carbon-comprising frame region. The carbon-comprising frame region can have a head region and/or a handle region.

The production method according to the invention further comprises connecting the bridge to the carbon-comprising frame region. For this purpose, the bridge can, e.g., be bonded to, pressed to, welded to, cured together with, riveted to and/or screwed to the frame region.

The carbon-comprising frame region can be a finished or unfinished frame region. The step of connecting the bridge to the carbon-comprising frame region and the step of finishing and/or permanently shaping the carbon-comprising frame region can generally take place in one method step.

In particular, the unfinished carbon-comprising frame region can be prepreg layers intended for manufacturing the carbon-comprising frame region in the blow tube molding.

Preferably, the bridge is inserted together with prepreg layers, which form the carbon-containing frame region after finishing, into a blow tube mold and pressed and cured.

The present invention relates in particular to the following aspects:

1. A bridge for a ball game racket comprising magnesium.
2. The bridge according to the preceding aspect, wherein the bridge has a hollow profile.
3. The bridge according to any of the preceding aspects, wherein the wall thickness of the bridge varies along a cross-section through the frame profile.
4. The bridge according to any of the preceding aspects, wherein the bridge has a solid profile.
5. The bridge according to any of the preceding aspects, wherein the bridge comprises a central region and two edge regions which are intended for being connected to the frame of a ball game racket, wherein from both sides of the central region a lower web (or ligament or beam) and two upper webs (or ligaments or beams) respectively extend to the two edge regions, wherein the central region comprises first through openings for receiving longitudinal strings and wherein at least two further second through openings are arranged for receiving longitudinal strings in such a manner that the longitudinal strings to be received therein each extend between the corresponding two upper webs.
6. The bridge according to any of the preceding aspects, wherein the longitudinal strings to be received by the at least two second through openings each extend in a contactless manner between the corresponding two upper webs.
7. The bridge according to any of the preceding aspects, wherein the respective lower web is not connected to any of the two upper webs between the central region and the corresponding edge region.
8. The bridge according to any of the preceding aspects, wherein the respective two upper webs are not connected with each other between the central region and the corresponding edge region.
9. The bridge according to any of the preceding aspects, wherein the respective surface distance between the two upper webs increases from the central region towards the corresponding edge region.
10. The bridge according to any of the preceding aspects, wherein a through opening is respectively formed between the two upper webs and the lower web perpendicularly with respect to a plane defined by the stringing, the sectional area of said plane, which is oriented parallel with respect to the plane defined by the stringing, being preferably at least 1.5 $cm^2$, more preferably at least 2 $cm^2$ and particularly preferably at least 2.5 $cm^2$.
11. The bridge according to any of the preceding aspects, wherein the two edge regions each comprise brackets or mounting links which are suitable for connecting the bridge to a racket frame to be made by using the blow tube molding.
12. The bridge according to aspect 11, wherein the brackets each have, at least in portions, a concave outer surface which is preferably at least 10 $cm^2$, more preferably at least 15 $cm^2$ and particularly preferably at least 20 $cm^2$.
13. The bridge according to aspect 11 or 12, wherein at least one of the second through openings is respectively arranged in a corresponding one of the brackets.

14. The bridge according to aspect 11, 12 or 13, wherein the brackets each have at least one, preferably two third through opening(s) for receiving longitudinal and/or transverse strings.
15. The bridge according to any of the preceding aspects, wherein the central region is groove-shaped and wherein the sides of the groove are each configured as a continuous side wall or as a lattice or truss structure.
16. The bridge according to aspect 15, wherein the groove has opposing edges from which the webs extend to the edge regions, and wherein the groove is closed at said opposing edges by means of a respective end wall.
17. The bridge according to aspect 15 or 16, wherein the bottom of the groove comprises at least two, preferably at least three, preferably at least four through openings for receiving longitudinal strings.
18. The bridge according to any of the preceding aspects, wherein at least some, preferably all through openings are configured for receiving one single string.
19. The bridge according to any of the preceding aspects, wherein at least one of the second through openings is respectively arranged in a corresponding one of the lower webs.
20. The bridge according to any of the preceding aspects, wherein from both sides of the central region two lower webs respectively extend to the two edge regions.
21. The bridge according to aspect 20, wherein the longitudinal strings to be received by the second through openings each extend between the corresponding two lower webs.
22. The bridge according to any of the preceding aspects, wherein the bridge is formed as a cast metal part, preferably as an injection molded metal part.
23. The bridge according to any of the preceding aspects, wherein the bridge has a geometrical moment of inertia Iz and a geometrical moment of inertia Iy.
24. The bridge according to aspect 23, wherein, along the x-axis, Iz(x) is, at least in portions, larger than Iy(x).
25. The bridge for a ball game racket according to any of aspects 23 to 24, wherein the value of Iz(x) along the x-axis is, at least in portions, 2500 $mm^4$ or more, preferably 3000 $mm^4$ or more, more preferably 3500 $mm^4$ or more, more preferably 4000 $mm^4$ or more, particularly preferably 4500 $mm^4$ or more.
26. The bridge for a ball game racket according to any of aspects 23 to 25, wherein there is at least one value pair d1 and d2 having like signs, for which Iz(x) is larger at the place x=d1 than at the place x=d2 and Iy(x) is smaller at the place x=d1 than at the place x=d2.
27. The bridge for a ball game racket according to any of aspects 23 to 26, wherein the bridge has at least one, preferably at least two regions A1, in which Iz(x) increases as the absolute value of x increases and in which Iy(x) decreases as the absolute value of x increases, wherein the one or the more regions A1 preferably each have an extension in the x-direction of 1 mm or more, preferably 5 mm or more, more preferably 10 mm or more, particularly preferably 15 mm or more.
28. The bridge for a ball game racket according to any of aspects 23 to 27, wherein Iz(x) differs from Iy(x) along the x-axis, at least in portions, by 2000 $mm^4$ or less, preferably 1500 $mm^4$ or less, particularly preferably 1000 $mm^4$ or less and/or Iz(x) differs from Iy(x) along the x-axis, at least in portions, by 1500 $mm^4$ or more, preferably 2000 $mm^4$ or more, more preferably 2500 $mm^4$ or more.
29. The bridge for a ball game racket according to any of aspects 23 to 28, wherein the bridge comprises one or more regions A2, wherein Iy(x) and Iz(x) have substantially the same absolute change within the respective regions A2.
30. The bridge for a ball game racket according to any of aspects 23 to 29, wherein Iz comprises a maximum and Iy a minimum.
31. The bridge for a ball game racket according to any of aspects 23 to 30, wherein the value of Iz(x) and/or the value of Iy(x) has a variation of at least 100% of its smallest value or more along an axis region A3 of 15 mm or less, preferably 10 mm or less, particularly preferably 5 mm or less.
32. The bridge according to any of aspects 23 to 31, wherein Iy(x) is, at least in portions, larger than Iz(x).
33. The bridge for a ball game racket according to any of aspects 23 to 32, wherein the value of Iz(x) is, at least in portions, 6500 $mm^4$ or less, preferably 6000 $mm^4$ or less, more preferably 5500 $mm^4$ or less, particularly preferably 5000 $mm^4$ or less.
34. The bridge for a ball game racket according to any of aspects 23 to 33, wherein the value of Iy(x) is, at least in portions, in a range of 100 $mm^4$ to 4000 $mm^4$, preferably 500 $mm^4$ to 3500 $mm^4$, more preferably 1000 $mm^4$ to 3000 $mm^4$, more preferably 1500 $mm^4$ to 2500 $mm^4$, particularly preferably 2300 $mm^4$ to 2500 $mm^4$ and/or, at least in portions, in a range of 100 $mm^4$ to 2500 $mm^4$, preferably 250 $mm^4$ to 2000 $mm^4$, more preferably 500 $mm^4$ to 1500 $mm^4$, particularly preferably 750 $mm^4$ to 1000 $mm^4$.
35. A ball game racket having a racket frame which comprises a handle region, a racket head and a heart region arranged therebetween, the heart region being formed by a bridge according to any of the preceding aspects and two frame bars extending from the handle region.
36. The ball game racket according to aspect 35, further comprising a stringing formed by longitudinal and transverse strings, wherein at least one first longitudinal string is passed through a through opening in the central region of the bridge and at least one second longitudinal string is passed through a respective through opening of two lower webs of the bridge, and wherein the two second longitudinal strings each extend between two corresponding upper webs of the bridge.
37. The ball game racket according to aspect 35 or 36, wherein the racket frame is formed as a hollow profile made of carbon fiber and is integrally formed with the bridge.
38. A ball game racket having a racket frame which comprises a handle region, a racket head and a heart region arranged therebetween, the heart region being formed by two frame bars extending from the handle region and a bridge, wherein the bridge has a central region and two edge regions which are provided for being connected to the frame of a ball game racket, wherein from both sides of the central region a lower web or ligament or beam and two upper webs respectively extend to the two edge regions, wherein the central region has first through openings for receiving longitudinal strings and wherein at least two further second through openings are arranged in the two frame bars for receiving longitudinal strings in such a manner that the longitudinal strings to be received therein each extend between the corresponding two upper webs.

39. A frame for a ball game racket comprising a bridge, each according to any of the preceding aspects, wherein the frame has a hollow profile.
40. A frame for a ball game racket according to any of the preceding aspects, comprising a bridge according to any of the preceding aspects, wherein the frame has a solid profile.
41. A frame for a ball game racket according to any of the preceding aspects, comprising a bridge according to any of the preceding aspects, wherein the frame comprises carbon.
42. A frame for a ball game racket according to any of the preceding aspects, comprising a bridge according to any of the preceding aspects, wherein the frame comprises a carbon-fiber composite material.
43. A frame for a ball game racket according to any of the preceding aspects, comprising a bridge according to any of the preceding aspects, wherein the frame comprises a prepreg tube.
44. A ball game racket comprising a stringing and a racket frame according to any of the preceding aspects, which comprises a handle region, a racket head and a heart region arranged therebetween, wherein the heart region is formed by two frame bars extending from the handle region and a bridge according to any of the preceding aspects, wherein the bridge comprises two edge regions which are intended for being connected to the frame of a ball game racket.

In the following, preferred embodiments of the frame according to the invention are described in more detail on the basis of the Figures in which FIG. 1 shows a schematic front view of a frame according to the invention;

Figure 1:
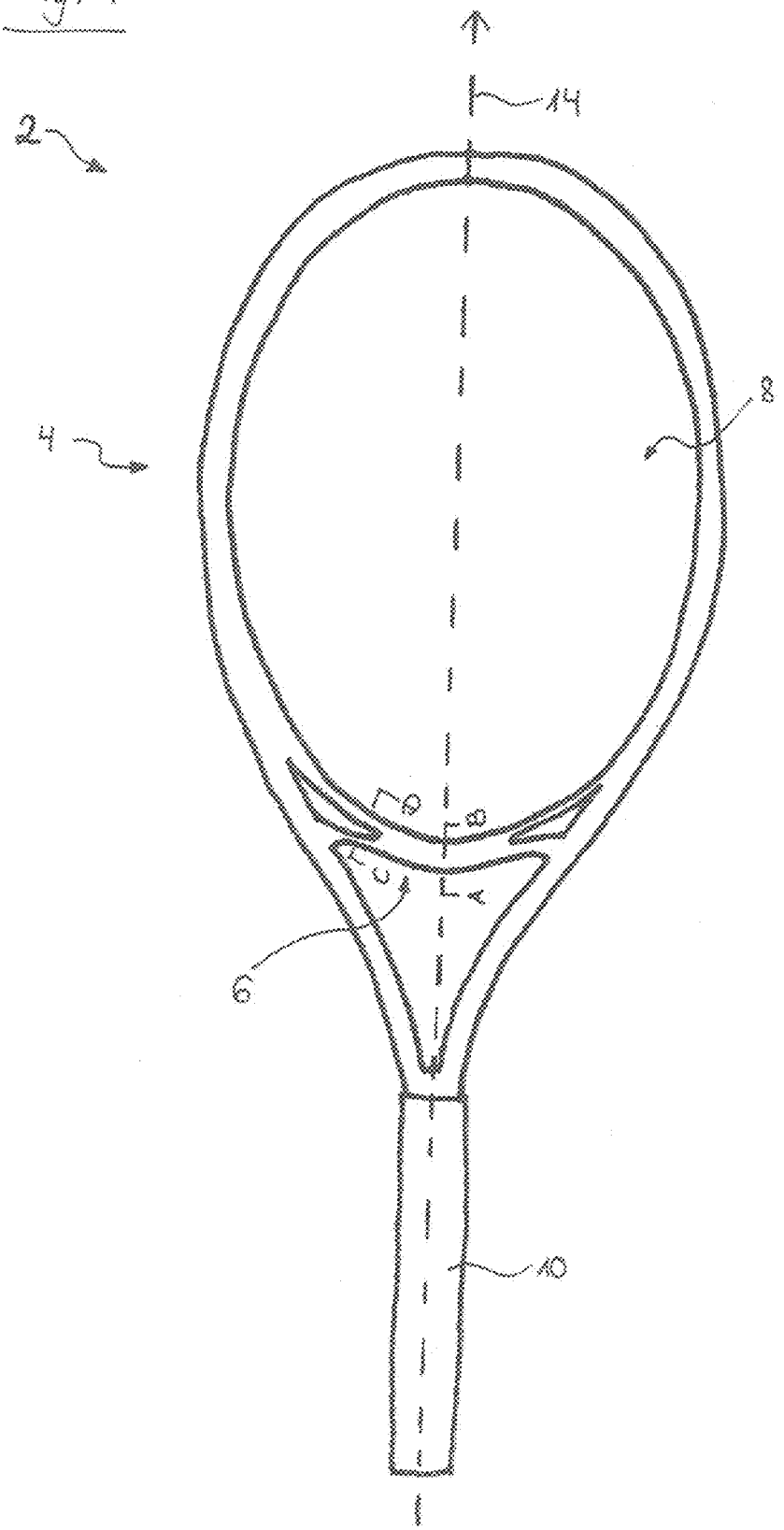
Figure 6A:
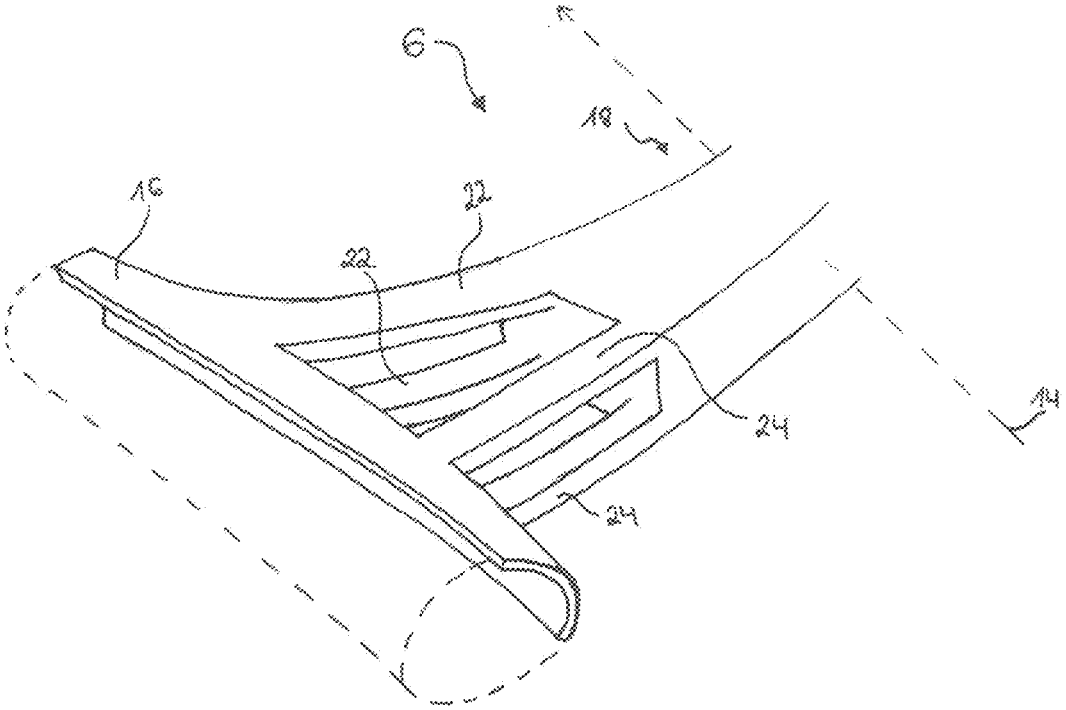
Figure 6B:
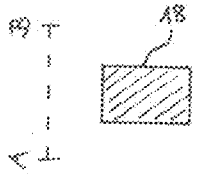
Figure 6C:
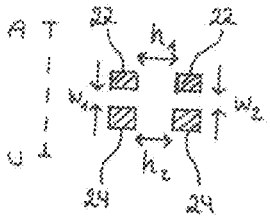
Figure 6D:
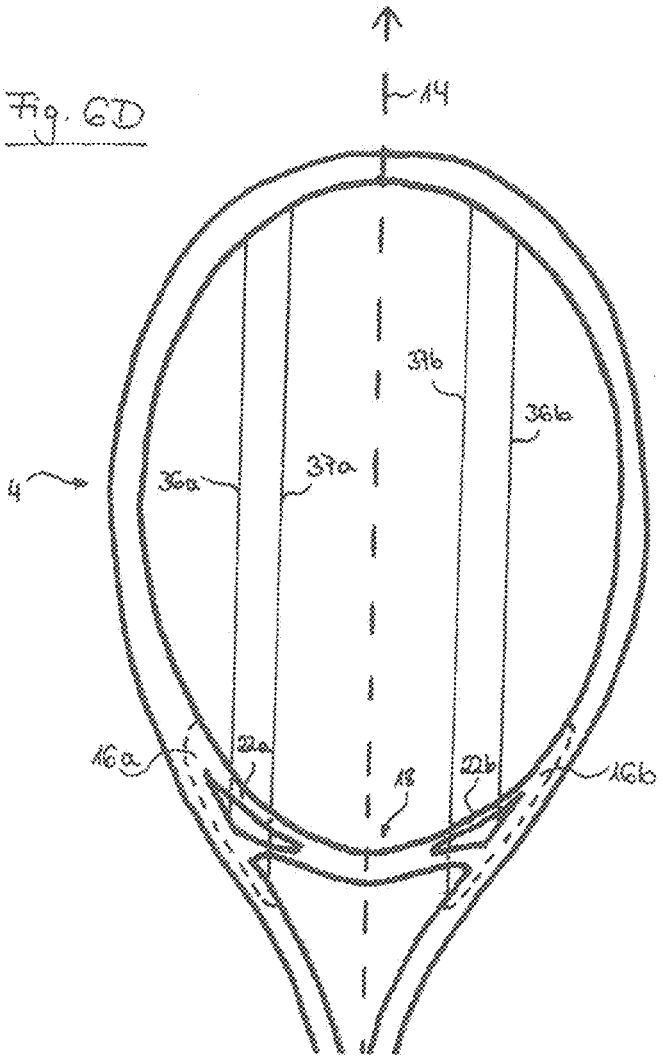
Figure 6E:
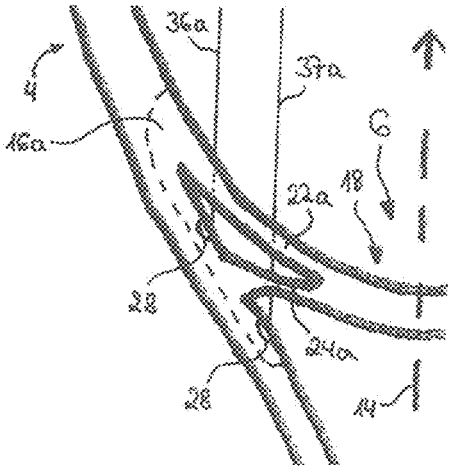
Figure 7A:
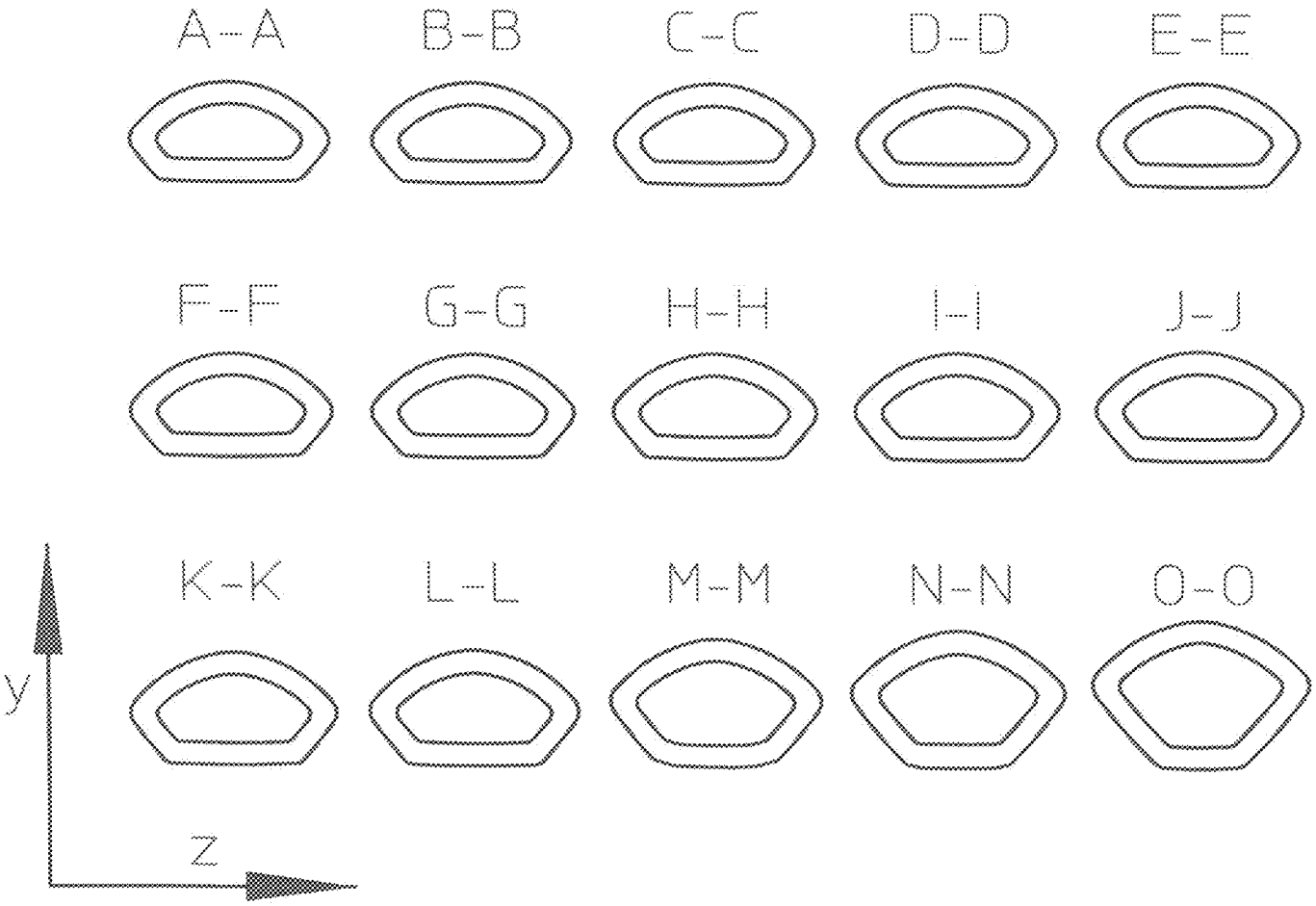
Figure 7B:
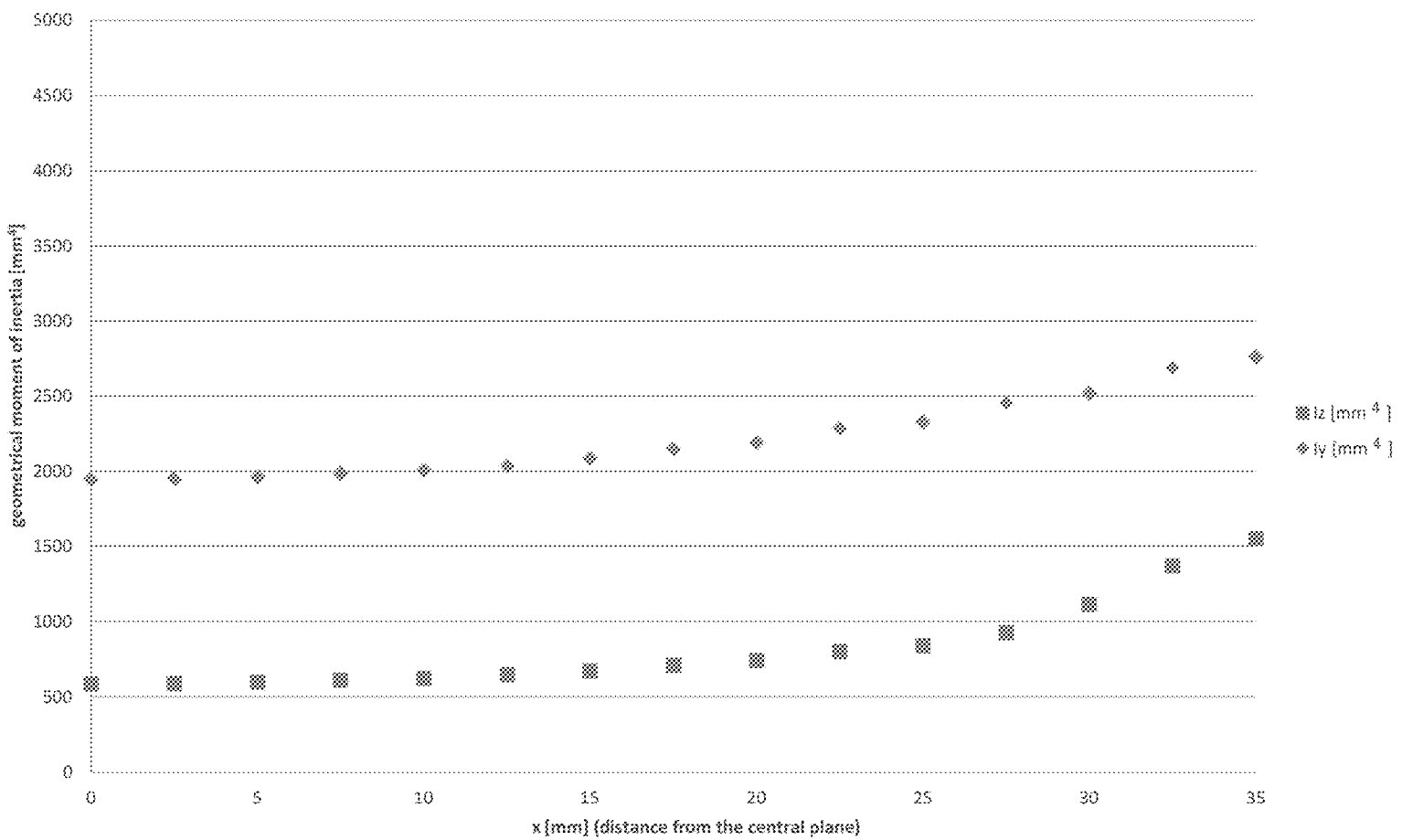
Figure 7C:
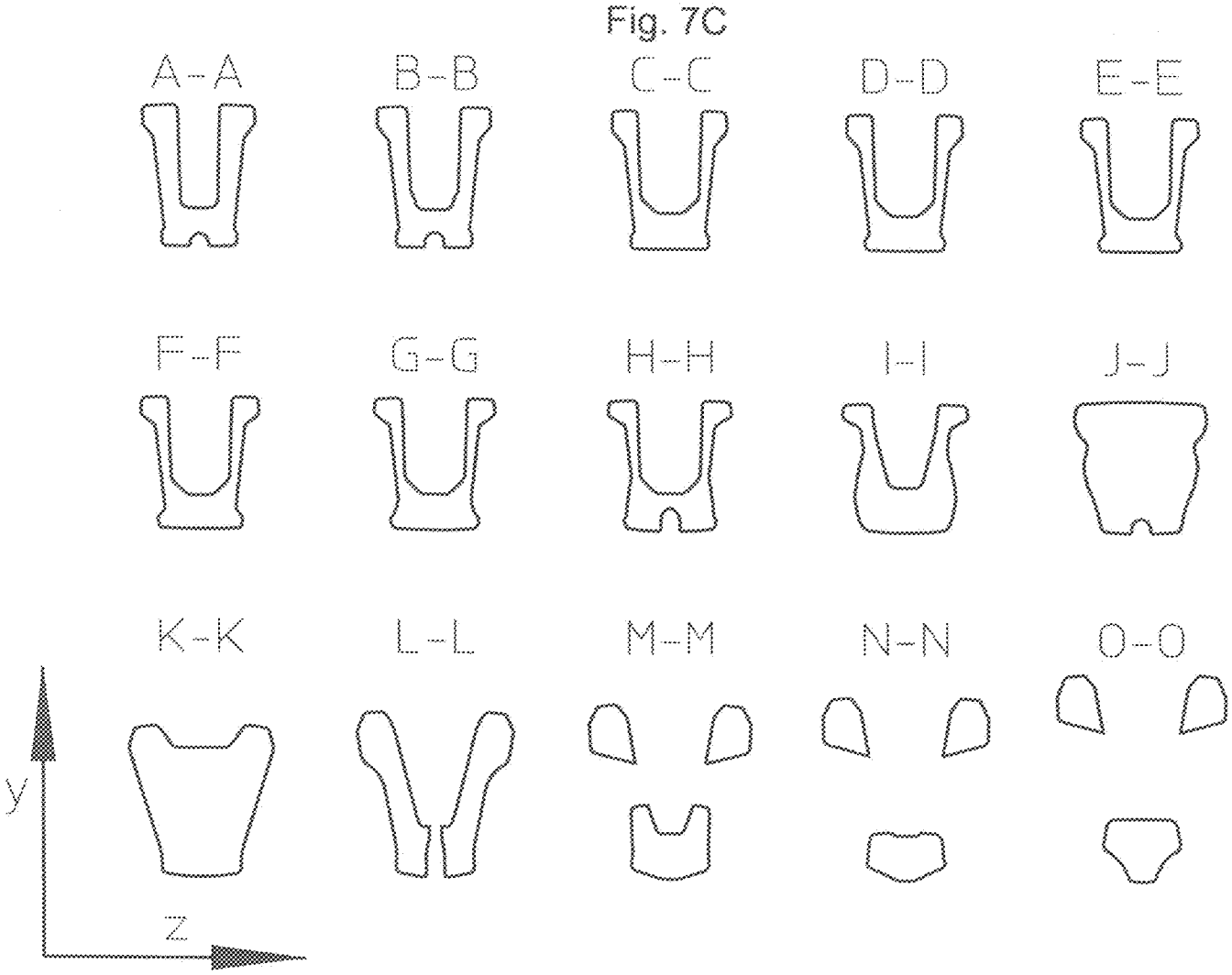
Figure 7D:
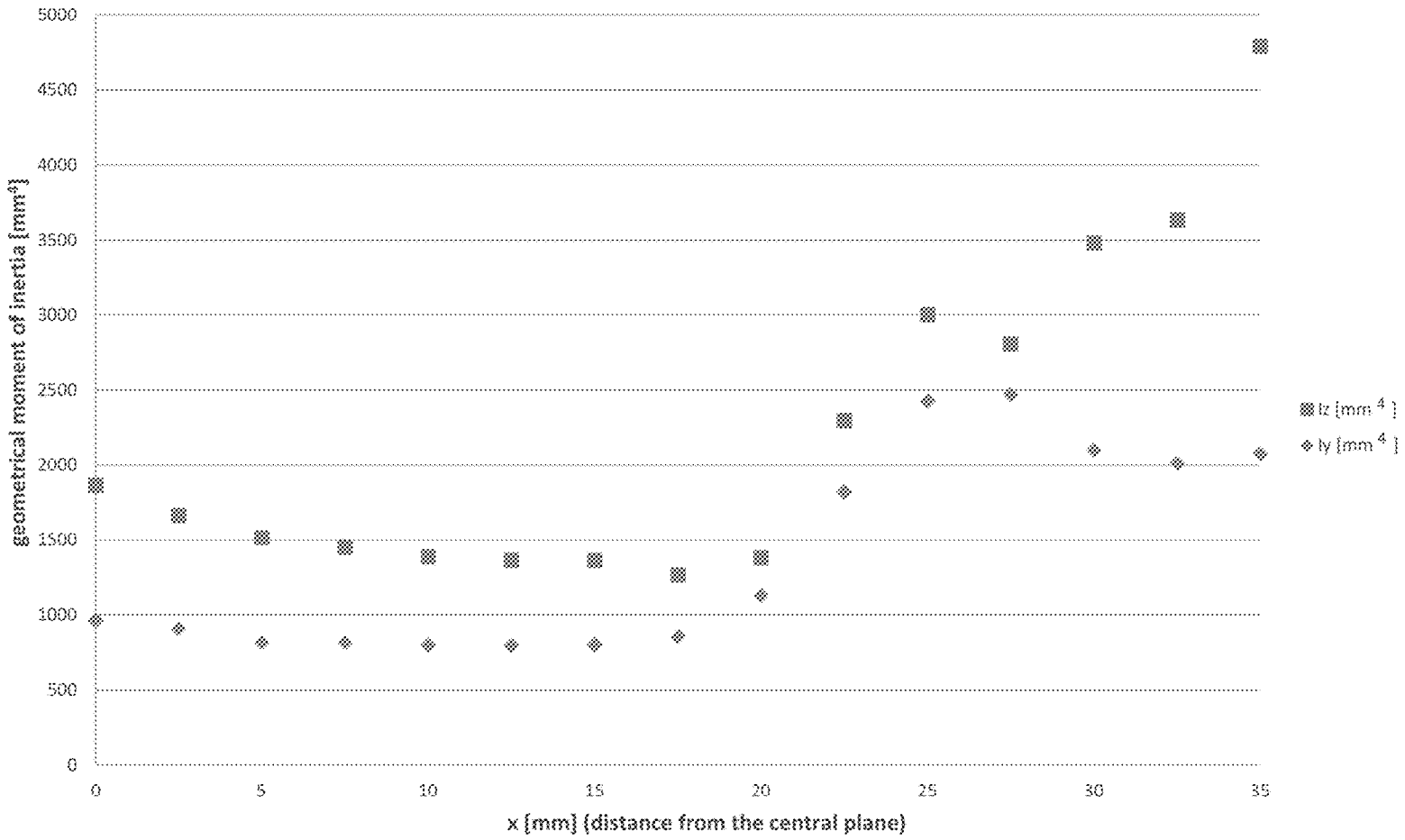

FIGS. 5A-5D each show a schematic front view of a bridge according to the invention;

FIG. 6A shows a schematic perspective partial view of a bridge according to the invention;

FIG. 6B shows a schematic view of a cross-section of the bridge of FIG. 6A through the line A-B according to FIG. 1;

FIG. 6C shows a schematic view of a cross-section of the bridge of FIG. 6A through the line C-D according to FIG. 1;

FIG. 6D shows a schematic front view of a portion of a frame according to the invention with the bridge of FIG. 6A;

FIG. 6E shows an enlarged detail of FIG. 6D;

FIG. 7A shows the yz-sections of a bridge of a conventional frame of a ball game racket;

FIG. 7B shows a diagram of calculated geometrical moments of inertia of the yz-sections of FIG. 7A;

FIG. 7C shows the yz-sections of a bridge of a frame of a ball game racket according to the invention;

FIG. 7D shows a diagram of calculated geometrical moments of inertia of the yz-sections of FIG. 7C.

FIG. 1 shows a schematic front view of a frame 2 for a ball game racket according to the present invention. The frame 2 comprises a head region 4 with a bridge region or bridge 6. The head region 4 with the bridge 6 defines a string bed 8 for receiving a stringing (not shown). Moreover, the frame 2 comprises a handle region 10, the central axis of which coincides with the longitudinal axis 14 of the frame 2.

In the preferred embodiment of the frame 2 of FIG. 1, the bridge comprises a magnesium alloy and the frame comprises a carbon-fiber composite material. Furthermore, the bridge is formed as one part. In the shown preferred embodiment, the bridge is formed substantially completely from a uniform material.

Figure 2A:
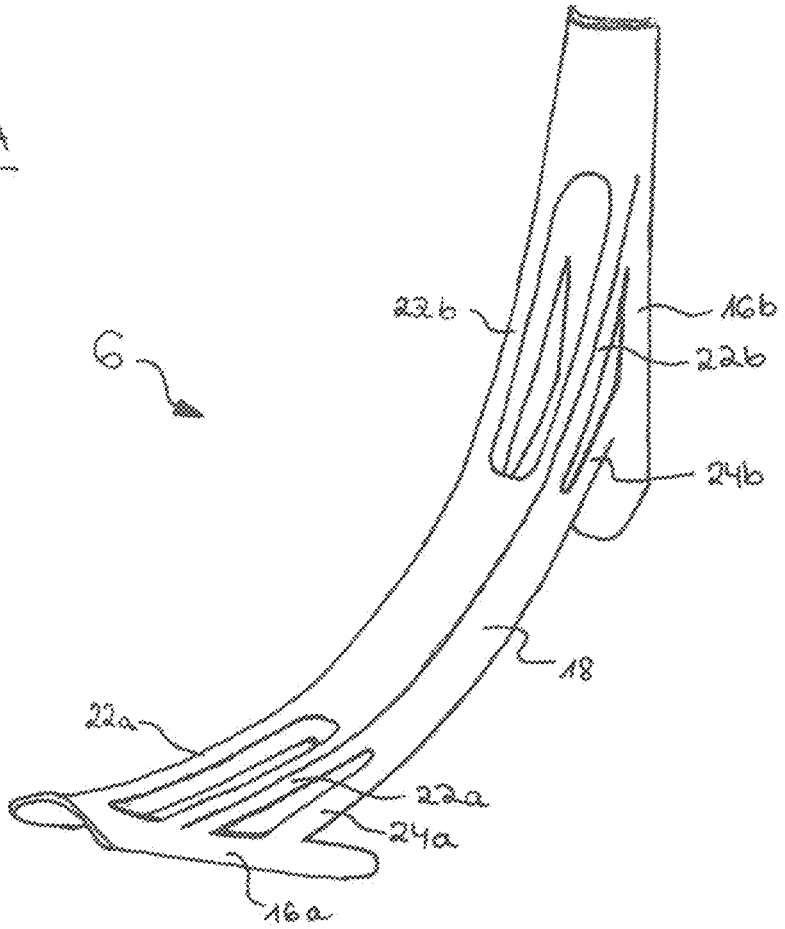
FIG. 2A shows a schematic perspective view of a bridge according to the invention.

A preferred embodiment of a bridge region or a bridge 6 according to the invention is shown in a perspective view in FIG. 2A. In its preferred embodiment of FIG. 2A, the bridge 6 comprises two brackets or mounting links 16*a*, 16*b* which serve for connecting the bridge to at least one further frame region. The brackets 16*a*, 16*b* limit the shown bridge 6 at both ends of its directrix. In the center between the two brackets 16, the bridge 6 comprises a central region 18 which, on two sides to which the indices a and b are assigned, is respectively connected via two upper webs or ligaments or beams 22*a* and 22*b* and one lower web 24*a* or 24*b* to the two brackets 16*a* and 16*b*.

Figure 2B:
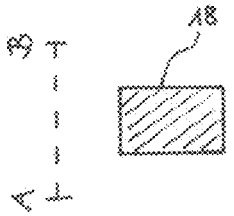
FIG. 2B shows a schematic view of a cross-section of the bridge of FIG. 2A through the line A-B according to FIG. 1.
Figure 2C:
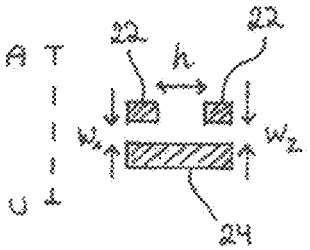
FIG. 2C shows a schematic view of a cross-section of the bridge of FIG. 2A through the line C-D according to FIG. 1.

In the shown preferred embodiment of FIG. 2A, the bridge 6 is configured as a one-part cast part having a solid profile and comprises a uniform magnesium alloy. FIG. 2B shows a cross-section of the bridge of FIG. 2A through the line A-B according to FIG. 1. FIG. 2B thus shows a cross-section through the central region 18 of the bridge of FIG. 2A. As shown in FIG. 2B, the bridge comprises a central region 18 with an exclusively convex cross-section which is herein exemplarily substantially rectangular. FIG. 2C shows a cross-section of the bridge of FIG. 2A through the line C-D according to FIG. 1. FIG. 2C thus shows a cross-section through the web region of the bridge of FIG. 2A. As shown in FIG. 2C, the webs 22 and 24 of the bridge also each have a convex cross-sectional profile, also exemplarily shown to be substantially rectangular.

It is stressed that the arrangement of the webs relative to one another as well as the areas of the individual web cross-sections are understood to be only schematic and exemplary. Thus, in particular the surface distances between two neighboring webs are not restricted to the shown web surface distances h, w1 and w2, wherein h is a surface distance between two neighboring webs perpendicular with respect to the string bed plane and w1 and w2 each show a surface distance between two neighboring webs parallel with respect to the string bed plane. Alternative embodiments with other web arrangements, web profile shapes, cross-sectional areas of the webs and/or surface distances of the webs are possible. In particular, oval, round, convexly or concavely polygonal and/or irregular web cross-sections are possible. Cross-sectional areas and shapes of webs of the same embodiment can generally differ from each other. The values of web arrangements, web lengths, web profile shapes, cross-sectional areas of webs and/or web surface distances and also the values of bridge lengths, bridge profile shapes and/or cross-sectional areas of bridges preferably is in the ranges described above.

As shown in FIGS. 2A and 2C, the use of a one-part solid profile made from a magnesium alloy allows the formation of particularly filigree structures such as, e.g., the upper webs 22*a*, 22*b*, whose minimum extension along a cross-sectional area can, e.g., be smaller than 3 mm. For example, cross-sectional areas in the range of 5 $mm^2$ to 10 $mm^2$ can be achieved without increasing the risk of fracture of the bridge substantially.

Figure 3A:
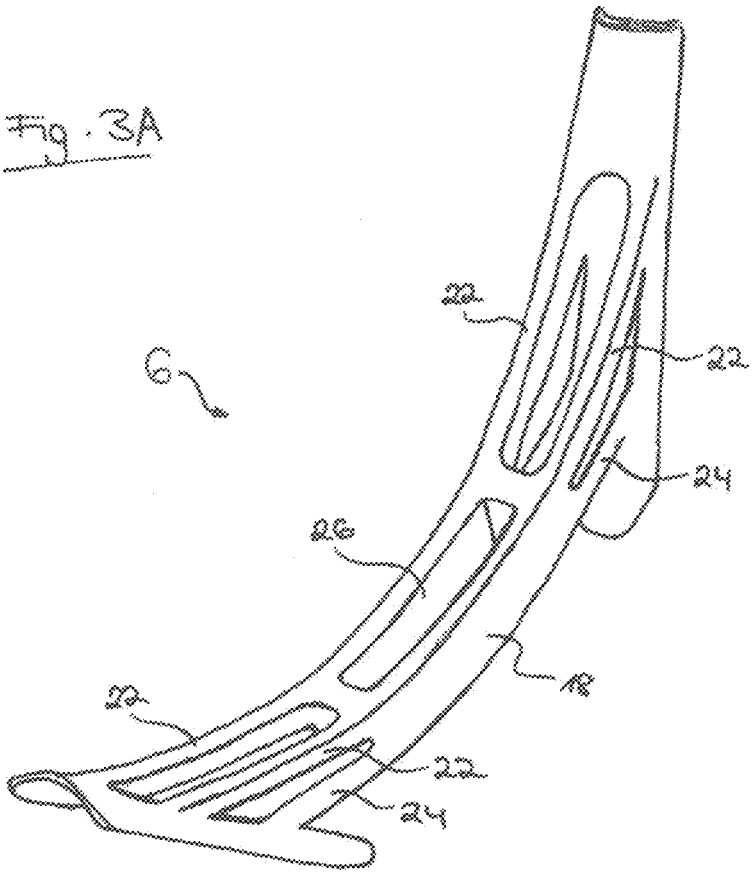
FIG. 3A shows a schematic perspective view of a further bridge according to the invention.
Figure 3B:
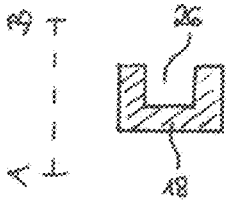
FIG. 3B shows a schematic view of a cross-section of the bridge of FIG. 3A through the line A-B according to FIG. 1.
Figure 3C:
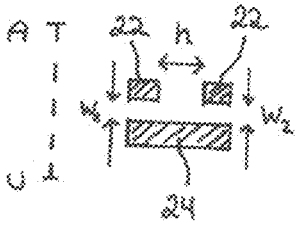
FIG. 3C shows a schematic view of a cross-section of the bridge of FIG. 3A through the line C-D according to FIG. 1.

FIG. 3A shows a further embodiment of a bridge 6 of a frame 2 according to the invention, in which also the central region 18 is more filigree than in the case of FIG. 2A. The bridge 6 of FIG. 3A comprises uniformly a magnesium alloy and is configured as one-part cast part having a solid profile. In the center between the two brackets 16, the bridge 6 comprises a central region 18 which, on two sides to which the indices a and b are again assigned, is respectively connected via two upper webs 22*a* and 22*b* and one lower web 24*a* or 24*b* to the two brackets 16*a* and 16*b*. FIG. 3B shows a cross-section of the bridge of FIG. 3A through the line A-B according to FIG. 1. FIG. 3B thus shows a cross-section through the central region 18 of the bridge of FIG. 3A. As shown in FIG. 3B, the bridge of FIG. 3A has a groove-shaped recess 26 in the central region 18. The groove-shaped recess 26 has a side which is open towards the string bed but is closed on both sides a and b, and, therefore, can be called pot-shaped. Furthermore, FIG. 3C shows a cross-section of the bridge of FIG. 3A through the line C-D according to FIG. 1. FIG. 3C thus shows a cross-section through the web region of the bridge of FIG. 3A. The bridge 6 of FIG. 3A comprises webs 22 and 24 with convex cross-sectional profiles, exemplarily shown as being substantially rectangular. Also this pot-shaped central region 18 of the bridge of FIG. 3A is formed as solid profile or is solid, i.e. the pot-shaped central region does not have any hollow spaces and, in particular, is not formed of opposing wall regions which would enclose a hollow space.

It is stressed that the arrangement of the webs relative to one another as well as the areas of the individual web cross-sections are understood to be only schematic and exemplary. Thus, in particular the surface distances between two neighboring webs are not restricted to the shown web surface distances h, w1 and w2, wherein h is a surface distance between two neighboring webs perpendicular with respect to the string bed plane and w1 and w2 each show a surface distance between two neighboring webs parallel with respect to the string bed plane. Alternative embodiments with other web arrangements, web profile shapes, cross-sectional shapes of the webs and/or web surface distances are possible. In particular, oval, round, convexly or concavely polygonal and/or irregular web cross-sections are possible. Cross-sectional areas and shapes of webs of the same embodiment can generally differ from each other. The values of web arrangements, web lengths, web profile shapes, cross-sectional areas of webs and/or web surface distances and also the values of bridge lengths, bridge profile shapes and/or cross-sectional areas of bridges preferably is in the ranges described above.

Figure 4:
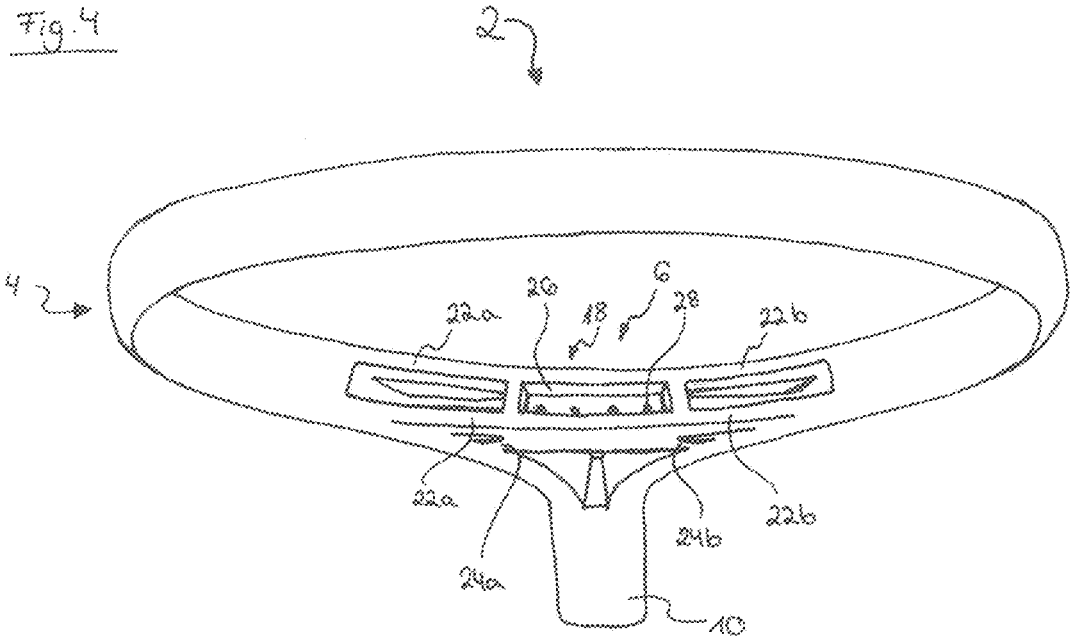
FIG. 4 shows a schematic perspective view of a frame according to the invention in a front view seen in an inclined manner from the top.

FIG. 4 shows a schematic perspective view of a frame according to the invention with the bridge according to FIG. 3. The frame comprises a handle region 10 and a head region 4 with bridge 6 in a front view seen in an inclined manner from the top. The central region 18 is in the center of the bridge 6. Two upper webs 22*a* and two upper webs 22*b* extend from the central region 18 and extend towards the closest bracket, respectively, with the brackets not shown here because in the finished racket frame the brackets are preferably incorporated in the carbon fiber composite material of the racket head. The central region 18 has a groove-shaped recess 26 which is open towards the string bed 8. The end sides facing in the direction of sides a and b, as well as the side (bottom) of the groove facing in the direction of the handle region 10, however, are closed, so that the central region 18 can be called pot-shaped. The bottom of the pot-shaped groove 26 has a string opening 28, as specified above, through which a string of the stringing is passed. At least one string opening 28 is provided in the bottom of the pot-shaped groove 26. In the preferred embodiment of FIG. 4, the bottom of the groove 26 has four string openings 28.

FIGS. 5A to 5D exemplarily show four further embodiments of the bridge in a schematic front view. The embodiments correspond to the embodiments of FIG. 2 or FIGS. 3 and/or 4, but in addition to the features already described in connection with FIGS. 2, 3 and/or 4, they have a lattice or truss structure 30 in the central region 18. The lattice structure depends on the mutually dependent shapes of the struts 32 and the gaps 34 and on the number thereof.

The number of gaps or through openings 34 in FIGS. 5A and 5B is five. In alternative embodiments, the number of gaps 34 can have other values. For example, the embodiment of FIG. 5C shows three gaps 34, while the embodiment of FIG. 5D shows nine gaps 34. However, the number of gaps 34 is preferably at least 2.

In general, the gaps can have many shapes. For example, the gaps 34 can be oval, triangular, quadrangular, convexly or concavely polygonal and/or have an irregular shape, wherein corners can be pointed or rounded.

In a front view, the embodiment of a bridge 6 according to the invention as shown in FIG. 5A has five round gaps 34. The alternative embodiment of a bridge 6 according to the invention as shown in FIG. 5B has, in a front view, five mostly triangular gaps 34, the apexes of which point alternatingly towards the racket head 4 and towards the handle region 10 (wherein the orientation of the triangular gaps 34 might also be inverted). The gap-triangles can have rounded corners and be oblique, equal-sided and/or equilateral. In the shown embodiment, the apexes of the middle and the two outer gap-triangles point towards the head region 4 and the apexes of the remaining two triangles towards the handle region 10. In alternative embodiments, the directions into which the apexes of the triangles point are the other way round. Alternatively, the triangles can also point in other directions.

A lattice structure according to the invention can have similarly shaped gaps 34 and/or similarly shaped struts 32 and additionally or alternatively non-similarly shaped gaps 34 and/or non-similarly shaped struts. The areas of the gap shapes can remain the same within one embodiment, as shown in FIGS. 5A and 5B, or vary between the gap shapes, as shown in FIG. 5D.

The different lattice or truss structures shown in FIGS. 5A to 5D are only meant to be exemplary and should clarify that very complex and delicate structures can be manufactured by means of a one-part bridge made from a magnesium alloy. The use of magnesium provides for the required stability and light-weight construction, whereas the one-part form i.a. guarantees that the shown structures can be made with the required precision without fractures possibly occurring at joints. Preferably, the shown structures can be made in a casting, particularly preferably injection molding process, so that the finished bridge is made as one single cast or injection molded part.

FIG. 6A schematically shows a perspective detail of a further preferred embodiment of a bridge 6 according to the invention. In the shown preferred embodiment of FIG. 6A, the bridge 6 is realized as a one-part cast part having a solid profile and comprises a uniform magnesium alloy. A part of the frame region, with which the bridge is connected by way of the bracket, is indicated in dashed lines. The shown bridge portion of the bridge 6 of FIG. 6A comprises a bracket 16 and a part of the central region 18. The central region 18 is cut off in the drawing after the longitudinal axis 14. In this embodiment, the bridge 6 has four struts per side a or b, two upper struts 22 and two lower struts 24. FIG. 6B shows a cross-section of the bridge of FIG. 6A through the line A-B according to FIG. 1. FIG. 6B thus shows a cross-section through the central region 18 of the bridge of FIG. 6A. As shown in FIG. 6B, the bridge 6 has a central region 18 with solely convex cross-section, which is here exemplarily shown to be substantially rectangular. FIG. 6C shows a cross-section of the bridge 6 of FIG. 6A through the line C-D according to FIG. 1. FIG. 6C thus shows a cross-section through the web region of the bridge 6 of FIG. 6A. As shown in FIG. 6C, the webs or ligaments or beams 22 and 24 of the bridge 6 each also have a convex cross-sectional profile, which is also exemplarily shown to be substantially rectangular. It is stressed that the arrangement of the webs relative to one another as well as the areas of the individual web cross-sections are understood to be only schematic and exemplary. Thus, in particular the surface distances between two neighboring webs are not restricted to the shown web surface distances h1, h2, w1 and w2, wherein h1 and h2 each are a surface distance between two neighboring webs perpendicular with respect to the string bed plane and w1 and w2 each show a surface distance between two neighboring webs parallel with respect to the string bed plane. Alternative embodiments with other web arrangements, web profile shapes, cross-sectional areas of the webs and/or surface distances of the webs are possible. In particular, oval, round, convexly or concavely polygonal and/or irregular web cross-sections are possible. Cross-sectional areas and shapes of webs of the same embodiment can generally differ from each other. The values of web arrangements, web lengths, web profile shapes, cross-sectional areas of webs and/or web surface distances and also the values of bridge lengths, bridge profile shapes and/or cross-sectional areas of bridges preferably is in the ranges described above.

The embodiment of FIG. 6A is shown in a front view in FIG. 6D, so that the extension of the strings of the stringing is easily visible. In the embodiment of FIGS. 6A to 6E, none of the webs has a string opening 28. Instead, the longitudinal strings 36 and 37 each extend in a contactless manner between the two upper webs 22 of the corresponding side a or b and between the two lower webs 24 of the corresponding side a or b. The longitudinal strings 36 and 37 each engage with a string opening 28 in the bracket 16 of the corresponding side a or b. This is particularly clearly visible in FIG. 6E which shows an enlarged view of the frame area around side a of the bridge 6 of FIG. 6D. In FIGS. 6D and 6E, the boundaries between the brackets 16 and the adjoining, carbon-containing frame region are schematically marked by dashed lines. Alternatively or additionally, a string 36 and/or 37 can engage with the frame also outside the brackets and outside the bridge.

FIGS. 7A to 7D relate to calculated geometrical moments of inertia at different places of a bridge of a preferred embodiment of a frame of a ball game racket according to the invention as compared to a conventional bridge of a conventional frame of a ball game racket.

FIG. 7A shows yz-sections of a bridge of a conventional frame of a ball game racket at different places of the x-axis, wherein the x-axis is in accordance with the already described definition. The conventional frame of a ball game racket used as a basis for the calculation is a frame of a ball game racket which has a bridge that is configured substantially as a tube and is symmetrical with respect to a central plane. The yz-sections are, as already defined, sections perpendicular with respect to the x-axis. The places on the x-axis at which the shown yz-sections are located are spaced apart from each other by 2.5 mm on the x-axis, starting from the central plane of the bridge (x=0) up to a maximum value of x=35 mm. In terms of mathematics, thus yz-sections are shown for all x that are characterized in that x is taken from the set of {0 mm, 2.5 mm, 5.0 mm, . . . , 35.0 mm}. The yz-section at x=0 is referred to as A-A, the yz-section at x=2.5 mm as B-B, etc., up to O-O for the yz-section at x=35 mm. FIG. 7A also shows for the sake of clarity the y- and z-directions. Because of the symmetry of the bridges shown in FIGS. 7A and 7B, the yz-sections for the corresponding places in the negative x-axis area are identical to the respective yz-section at the positive x-value having the same absolute value |x|.

FIG. 7B shows the calculated geometrical moments of inertia for the yz-sections of a conventional frame of a ball game racket as shown in FIG. 7A. The graph shows the position on the racket's x-axis as abscissa and the geometrical moment of inertia as ordinate. The calculated Iz-values are shown as squares, the calculated Iy-values as rhombs. Both geometrical moments of inertia moderately increase as the absolute value of x increases. The Iz- and Iy-values run substantially parallel, i.e. the respective absolute increase from a first x-value $x_m$ to a second x-value $x_n$ is substantially the same for Iz and Iy. For all calculated values $x_i$ it holds true that $Iz(x=x_i)$ is smaller than $Iy(x=x_i)$. Iz of the conventional frame of a ball game racket ranges from about 500 $mm^4$ to about 1600 $mm^4$. Iy of the conventional frame of a ball game racket ranges from about 1900 $mm^4$ to about 2800 $mm^4$. A maximum and/or minimum do/does not occur.

FIG. 7C shows yz-sections of a bridge of a frame of a ball game racket according to the invention. The yz-sections are positioned and oriented in the coordinate system of the racket in the same manner as the yz-sections of FIG. 7A. Also the bridge of the embodiment of FIG. 7C is symmetrical with respect to the central plane, so that the shown yz-sections do not only apply, as shown, to the respective positive x-values but also to the respective negative x-values having the same absolute values |x|.

FIG. 7D shows the calculated geometrical moments of inertia for the yz-sections of a frame of a ball game racket according to the invention as shown in FIG. 7C. The abscissa again shows the x-values, the ordinate the geometrical moment of inertia, and the calculated Iz-values are shown as squares and the calculated Iy-values as rhombs. The graph shows clear differences as compared to the conventional frame of a ball game racket. For example, the calculated geometrical moments of inertia $Iz(x=x_i)$ of the bridge of an embodiment according to the invention are larger than the corresponding values of $Iy(x=x_i)$. Furthermore, the course of the values differs as x increases. In the embodiment according to the invention, there is a first region or range A2-1, approximately from x=0 mm to x=15 mm, in which Iz and Iy run substantially parallel with respect to each other and moreover show only a slight decrease as x increases. In a second region A2-2, Iz and Iy also extend substantially parallel with respect to each other, but they clearly increase as x increases. A2-2 covers the range of approximately 20 mm to 25 mm on the x-axis. In a third range A1, approximately from x=25 mm to x=35 mm, Iz increases steeply as x increases, while Iy decreases moderately as x increases. As already mentioned, the consideration of the geometrical moments of inertia with respect to a division into the ranges A1 to A3 relates to the global behavior. The value Iz(x=27.5 mm) for the yz-section L-L is thus to be classified as outlier because this yz-section has a reduced surface because of a string opening. Iz has a clearly higher value for all calculated $x_i$ than the conventional frame of a ball game racket as shown in FIGS. 7A and 7B. Moreover, the geometrical moment of inertia Iz is particularly high in the edge regions of the bridge according to the invention as compared to the Iz-values of a conventional frame of a ball game racket.

As the bridge of a ball game racket according to the invention has an increased Iz (as compared to a conventional racket frame), it has a clearly higher stiffness when being bent about the z-axis (the z-axis is perpendicular with respect to the stringing plane or string bed), wherein the forces act along the longitudinal strings. This is advantageous under the aspect of the energy balance during a strike. During a normal strike, a ball hits the stringing, i.e. the strings of a stringed frame of a ball game racket. The energy of the ball, in particular the kinetic energy of the ball relative to the racket, is transmitted in the form of vibrations, potential energy and friction to the ball itself, to the strings and to the frame of the ball game racket. It is generally known that during this process the stringing absorbs the smallest amount of the transmitted energy and the ball the greatest amount. The amount of energy that is absorbed by the frame of the ball game racket lies therebetween. The increased stiffness of the frame of the ball game racket according to the invention helps that less energy is absorbed and dissipated by the frame and instead more energy is absorbed by the strings. Thus, more energy can be made available for the acceleration of the ball, and the playing behavior of the ball game racket is improved.

The embodiments described on the basis of FIGS. 1A to 7D are—by no means final—examples for one-part bridges with filigree regions and for frames of ball game rackets comprising such bridges according to claim 1. By means of the presently known prior art, the fine structures in the form of webs or arms and/or in the form of the lattice or truss structure as shown in the examples cannot be made or can only be made with extremely high technical efforts. For example, the bridges as shown in the Figures could not be made with the required stability by the blow tube molding. On the basis of the manufacturing method suggested in the present application and by using a bridge that is formed as a one-part cast part, however, it is possible to manufacture also such and other, not explicitly described filigree structures.

The embodiments shown in FIGS. 1A to 7D are exemplary and by no means final. All Figures are considered to be schematic illustrations by means of which specific preferred features are to be discussed. Therefore, it is possible that features have been omitted in illustrations of embodiments for reasons of clarity. For example, in FIGS. 2A to 2C, 3A to 3C, 4 and 6A to 6D, the string openings 28 have been omitted completely or partly. This means that features from different illustrations can be combined as far as this is not explicitly excluded.

The invention claimed is:

1. A frame for a ball game racket having a handle region and a head region comprising a bridge, wherein a part of the head region and/or the handle region comprises a carbon fiber composite material and wherein the bridge comprises magnesium, is formed as one part, and comprises at least four webs.

2. The frame for a ball game racket according to claim 1, wherein the bridge is made from a uniform material.

3. The frame for a ball game racket according to claim 1, wherein the bridge comprises at least 50 wt.-% magnesium.

4. The frame for a ball game racket according to claim 1, wherein the bridge comprises at least 95 wt.-% magnesium.

5. The frame for a ball game racket according to claim 1, wherein the bridge comprises a magnesium alloy.

6. The frame for a ball game racket according to claim 1, wherein the bridge comprises a fiber or particle reinforced alloy.

7. The frame for a ball game racket according to claim 1, wherein the bridge comprises AM60.

8. The frame for a ball game racket according to claim 1, wherein the bridge is made in a die casting process or an injection molding process.

9. The frame for a ball game racket according to claim 1, wherein the bridge is made by thixomolding.

10. The frame for a ball game racket according to claim 1, wherein the bridge is formed at least in portions as a solid profile.

11. The frame for a ball game racket according to claim 1, wherein the bridge is formed completely as a solid profile.

12. The frame for a ball game racket according to claim 1, wherein the bridge comprises at least six webs.

13. The frame for a ball game racket according to claim 1, wherein the webs extend, at least in portions, in a manner separated from each other.

14. The frame for a ball game racket according to claim 13, wherein the webs extend, at least in portions, in a manner separated from each other along a length of at least 5 mm along the frame profile.

15. The frame for a ball game racket according to claim 13, wherein the webs extend, at least in portions, in a manner separated from each other along a length of at least 15 mm along the frame profile.

16. The frame for a ball game racket according to claim 1, wherein two neighboring webs have, at least in portions, a distance of 1 mm to 30 mm measured parallel with respect to the string bed plane.

17. The frame for a ball game racket according to claim 1, wherein two neighboring webs have, at least in portions, a distance of 5 mm to 10 mm measured parallel with respect to the string bed plane.

18. The frame for a ball game racket according to claim 1, wherein two neighboring webs have, at least in portions, a distance of 1 mm to 20 mm measured perpendicularly with respect to the string bed plane.

19. The frame for a ball game racket according to claim 1, wherein two neighboring webs have, at least in portions, a distance of 5 mm to 10 mm measured perpendicularly with respect to the string bed plane.

20. The frame for a ball game racket according to claim 1, wherein the webs have a cross-section with a solid profile.

21. The frame for a ball game racket according to claim 1, wherein at least two webs have string openings.

22. The frame for a ball game racket according to claim 1, wherein the webs each have, at least in portions, a cross-sectional area of 1 $mm^2$ to 100 $mm^2$.

23. The frame for a ball game racket according to claim 1, wherein the webs each have, at least in portions, a cross-sectional area of 2 $mm^2$ to 25 $mm^2$.

24. The frame for a ball game racket according to claim 1, wherein the webs each have a length of 1 mm to 120 mm along the directrix of the respective web.

25. The frame for a ball game racket according to claim 1, wherein the webs each have a length of 20 mm to 50 mm along the directrix of the respective web.

26. The frame for a ball game racket according to claim 1, wherein the bridge comprises at least two brackets, wherein the brackets serve for connecting the bridge to at least one second frame region.

27. A frame for a ball game racket having a handle region and a head region comprising a bridge, wherein a part of the head region and/or the handle region comprises a carbon fiber composite material and wherein the bridge comprises magnesium and is formed as one part, wherein a cross-section through the bridge has a continuous cross-sectional profile along a continuous bridge length of between 10 mm and 100 mm along the frame contour and has a discontinuous cross-sectional profile along a continuous bridge length of between 5 mm and 100 mm along the frame contour.

28. A frame for a ball game racket having a handle region and a head region comprising a bridge, wherein a part of the head region and/or the handle region comprises a carbon fiber composite material and wherein the bridge comprises magnesium and is formed as one part, wherein a cross-section through the bridge has a continuous cross-sectional profile along a continuous bridge length of between 30 mm and 80 mm along the frame contour and has a discontinuous cross-sectional profile along a continuous bridge length of between 10 mm and 60 mm along the frame contour.

29. A method for manufacturing the frame according to claim 1, wherein the method comprises the following steps:

casting the bridge from a material comprising magnesium by thixomolding, providing a frame region which comprises the handle region and the head region, and connecting the bridge to the frame region to form the frame.

30. The method according to claim 29, wherein the frame region includes a prepreg tube.

31. The method according to claim 30, wherein the connection of the bridge to the frame region takes place in one method step with the curing of the prepreg tube.

* * * * *